United States Patent [19]

Frazar

[11] 4,031,911

[45] June 28, 1977

[54] LAUNDRY MACHINE IMPROVED WATER TEMPERATURE CONTROL AND METHOD

[75] Inventor: Joseph H. Frazar, Louisville, Ky.

[73] Assignee: General Electric Company, Louisville, Ky.

[22] Filed: Apr. 30, 1976

[21] Appl. No.: 682,144

[52] U.S. Cl. ..... 137/3; 137/90; 236/12 R

[51] Int. Cl.² ..... F16K 11/24

[58] Field of Search ..... 137/3, 90; 236/12 R, 236/12 A; 134/68 R; 68/207

[56] References Cited

UNITED STATES PATENTS

| | | | |
|---|---|---|---|
| 2,523,799 | 9/1950 | Woodson | 236/12 X |
| 2,523,801 | 9/1950 | Woodson | 137/90 X |
| 2,533,624 | 12/1950 | Ray | 236/12 R |
| 2,619,284 | 11/1952 | Maddock-Glegg et al. | 236/12 R |
| 2,844,320 | 7/1958 | Cate | 236/12 R |
| 3,434,488 | 3/1969 | Talbot | 236/12 A |

*Primary Examiner*—William R. Cline

*Attorney, Agent, or Firm*—Frederick P. Weidner; Francis H. Boos

[57] ABSTRACT

An improved water temperature control and method for automatic clothes washers having a tub for containing water and a water valve with a hot water inlet and a cold water inlet, a temperature sensing control including a temperature responsive switch for controlling at least one of the water inlets, a water conduit from the water valve to the tub. The improvement is a water sampling tank having an inlet, an outlet, and a water chamber therebetween, the tank being arranged in water flow communication with the conduit between the water valve and the tub so that a small portion of water passing through the conduit is diverted through the chamber. The water temperature responsive switch is in temperature sensing relationship with the water in the chamber. The improved water temperature control and method minimizes the amount of cycling of the temperature responsive switch and the water valve solenoids while maintaining accurate control of the desired water being introduced from the water valves into the clothes washer tub.

11 Claims, 4 Drawing Figures

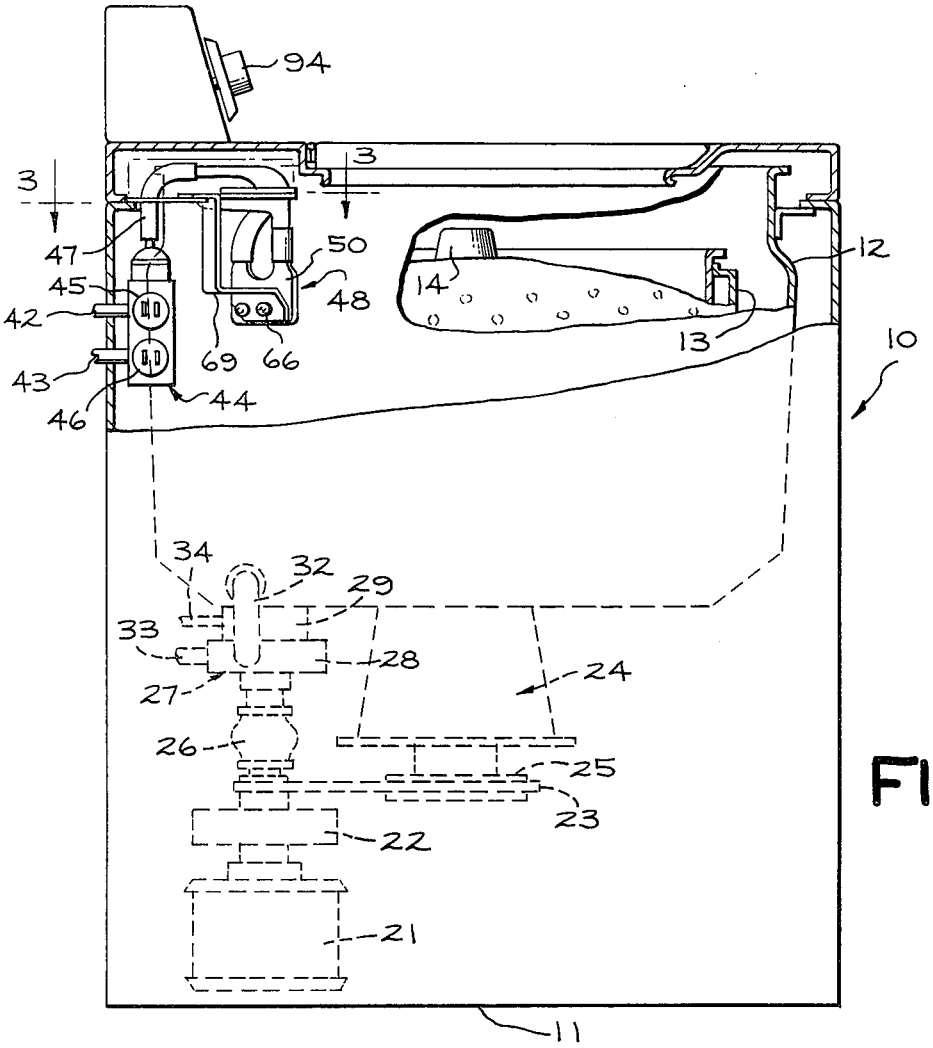
FIG. 1
FIG. 3
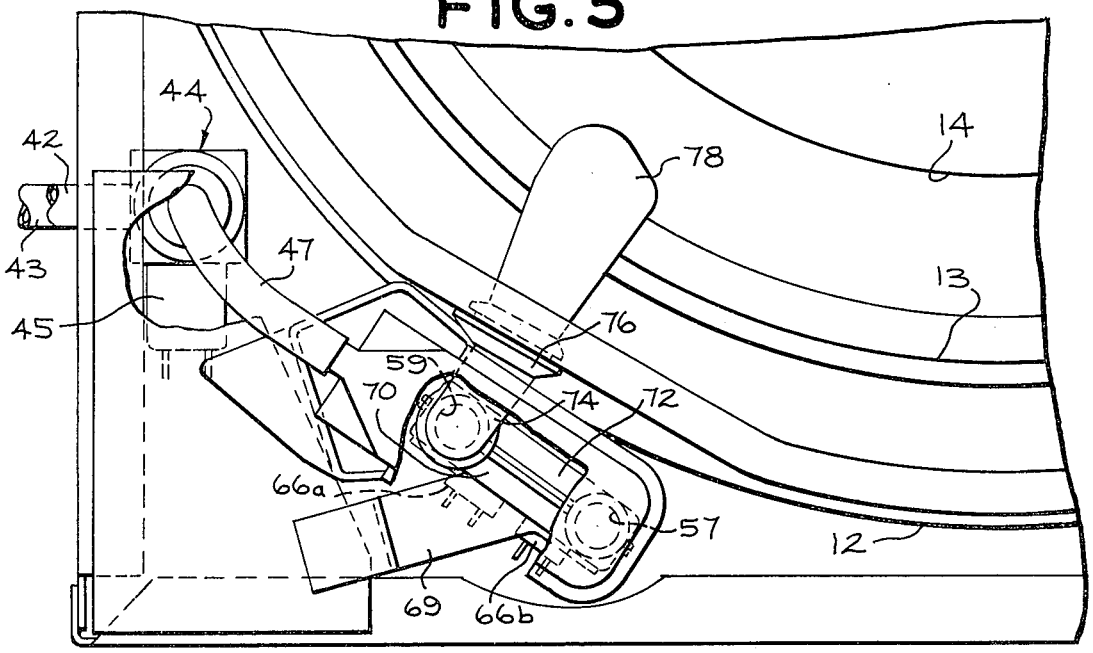

LAUNDRY MACHINE IMPROVED WATER TEMPERATURE CONTROL AND METHOD

BACKGROUND OF THE INVENTION

1. Field of the Invention

This invention relates to laundry machines, and more particularly, to automatic clothes washers that have a water temperature control, and to a method of controlling the water temperature.

2. Description of the Prior Art controlling the mixing of hot and cold water introduced into an automatic washing machine has been known for many years. By controlling the hot and cold water valves of the machine, the temperature of the mixed water may be regulated. Typically a temperature responsive switch, such as a thermostat, is located downstream of the water valves to sense the temperature of the mixed water and through approximate control and circuit means the opening and closing of the hot and cold water valves is controlled responsive to some predetermined temperature setting of the thermostat. One such typical arrangement is shown and described in U.S. Pat. No. 2,844,320 wherein the water valves are controlled by a thermostat located along a mutual output water line to the washing machine tub. Such an arrangement, however, has been found to detrimentally affect both the thermostat and the water valves dure to their excessive cycling on and off because of the rapid changes in the water temperature in the output water line.

Another arrangement that has been utilized is shown in U.S. Pat. No. 2,533,624 wherein the thermostat is located in a temperature sensing relationship with the washing machine tub which contains the mixed water. U.S. Pat. No. 2,619,284 also shows a thermostate located on the tub. Such prior arrangements, however, result in some basic difficulties. In most automatic washing machine there is an adjustment for the clothes load and therefore the level of water introduced into the tub for a given washing operation. The thermostat cannot have a fixed ideal location on the tub as the level of the mixed water varies. For instance, at low water level if the thermostat is located to sense that water, then when the machine controls are placed on the high water level fill, the thermostat does not accurately measure the incoming water when the level of water is above the thermostat location. Conversely, if the thermostat is located to measure the high water level temperature then if the machine controls are placed on the low water level, the incoming water temperature will not be sensed by the thermostat. In addition, water in the tub is poorly mixed and tends to stratify before the washer begins its agitation or washing operation. Therefore, a tub mounted thermostat might be sensing the temperature of a portion of the water in the tub that is not representative of the average temperature of the water in the tub. Another problem with the prior art arrangements is that the long time delay in the thermostat sensing the change in temperature of the relatively large volume of water in the tub does not allow for accurately controlling the water valves to regulate the mixed water temperature.

Therefore, in the prior art water temperature control arrangments for clothes washers, in the one case the control is so sensitive to changes in temperature of the mixed water leaving the water valves that the thermostat and valves excessively cycle on and off, thus detrimentally affecting the life of those components and in the other case, the sensing of the water in the tub is not accurate and maintaining the proper temperature control of the mixed water is not achieved.

By my invention, I have provided an automatic clothes washer with an improved water temperature control and method which minimizes the amount of cycling of the temperature responsive switch and the water valves while maintaining accurate control of the desired water being introduced from the valves into the clothes washer.

SUMMARY OF THE INVENTION

There is provided in an automatic washer having a tub for containing water and a water valve with a hot water inlet and a cold water inlet, a temperature sensing control means including a temperature responsive switch for controlling at least one of the said water inlets, a water conduit means from the water valve to the tube, an improved water temperature control and method. The improvement comprises utilizing a water sampling tank having an inlet opening, an outlet opening, and a water chamber therebetween, the tank being arranged in water flow communication with the conduit means between the water valve and tub so that a small portion of the water passing through the conduit means is diverted through the chamber. The water temperature responsive switch is in temperature sensing relationship with the water in the chamber and is calibrated to actuate at one preselected temperature and de-actuate at a preselected different temperature to regulate the temperature of the mixed water in the tub in the range between the two temperatures.

BRIEF DESCRIPTION OF THE DRAWINGS

FIG. 1 is a schematic side elevational view of a clothes washer incorporating my invention, the view being partly broken away and partly in section.

FIG. 3. is a top plan view taken along lines 3—3 of FIG. 1.

DESCRIPTION OF THE PREFERRED EMBODIMENT

Figure 2:
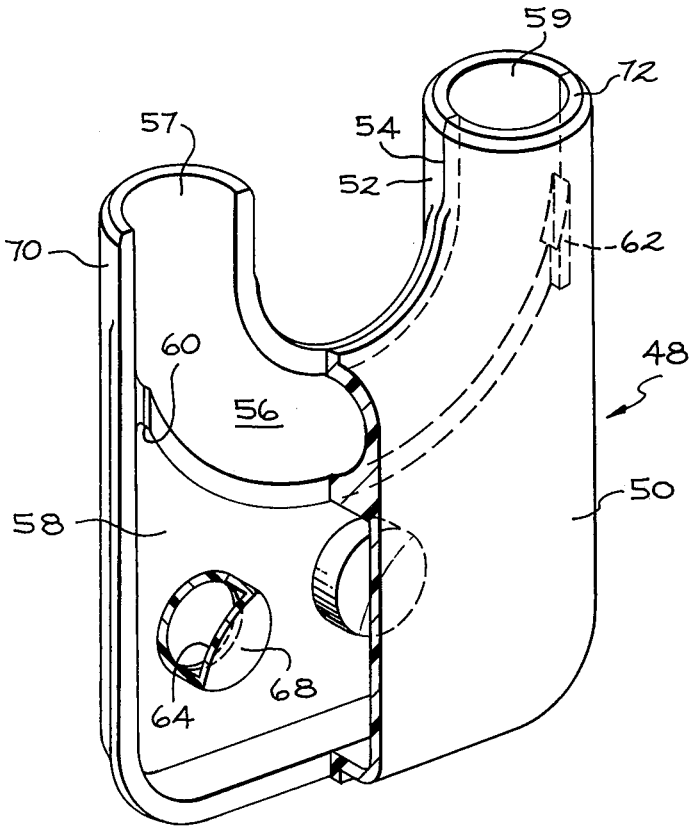
FIG. 2 is a perspective view of the water sampling tank of my invention, the view being partly broken away and partly in section.

Referring now to the drawing, and initially to FIG. 1 thereof, there is illustrated an agitator-type vertical-axis automatic clothes washer 10 having a supporting structure or load member 11. The washer may include the various operational components conventionally utilized in a domestic automatic washing machine, for instance, an imperforate tub 12 rigidly mounted within structure 11. Rotatably supported within the tub 12 is a perforate washing basket 13 for washing and rinsing clothes therein and for centrifugally extracting water therefrom. At the center of basket 13 there is provided an agitator 14.

Both the clothes basket 13 and the agitator 14 are rotatably mounted. During one cycle of operation of the washer 10, fabrics, detergent and a predetermined quantity of water are introduced into the tub 12 and basket 13, and the agitator is then oscillated back and forth about its axis to move the clothes within the basket. After a predetermined period of this washing action, the agitator and basket 13 are rotated in unison at high speed to centrifugally extract the wash water from the fabrics and discharge it to a drain (not shown). Following this extraction operation, a supply of clean water is introduced into the basket for rinsing the fabrics and the agitator is again oscillated. Finally, the agitator and basket are once more rotated in unison at high speed to extract the rinse water.

The basket 3 and agitator 14 may be driven by any suitable means. By way of example, I have shown them as driven by a reversible motor 21 through a drive mechanism including a clutch 22 mounted on the motor shaft. The motor is tailored so as to be used to its full extent when it accelerates the basket 13 to spin speed. In order to assist the motor during starting, clutch 22 allows the motor to start with less than a full load and then accept the full load as it comes up to speed. A suitable belt 23 transmits power from clutch 22 to a transmission assembly 24 through a pulley 25. Thus, depending upon the direction of motor rotation, the pulley 25 of transmission 24 is driven in opposite directions. The transmission 24 is so arranged that is supports and drives both the agitator 14 and the basket 13. When motor 21 is rotated in one direction, the transmission causes agitator 14 to oscillate and when motor 21 is driven in the opposite direction, the transmission causes the clothes basket 13 and agitator 14 to rotate together at high speed for centrifugal water extraction.

In addition to operating the transmission 24 as described, motor 21 also provides a direct drive through a flexible coupling 26 to a pump structure 27, which includes two separate pumping units 28 and 29 which are operated simultaneously in the same direction by motor 21. Pump unit 28 has a conduit 32 that is connected to the tub and an outlet connected by a conduit 33 to suitable external drain (not shown). Pump 29 has an inlet connected to the interior of tub 12 and an outlet connected by conduit 34 to a nozzle (not shown) which is positioned to dishcharge into the basket 13 for recirculating the wash water.

With this structure, then, when, the motor 21 is operating so as to provide the washing mode or agitation, pump unit 29 draws liquid in from tub 12 and discharges it through conduit 34 into basket 13. Conversely, when the motor is reversed so as to rotate the basket 13 and agitator 14 together at high speed to centrifugally extract water from fabrics in the basket, pump unit 28 will draw water from the tub through conduit 32 and discharge it through conduit 33 to drain. Each of the pump units is substantially inoperative in the direction of rotation in which it is not used.

Hot and cold water may be supplied to the machine through conduits 42 and 43 which are adapted to be connected respectively to sources of hot and cold water (not shown) such as household faucets. Conduits 42 and 43 extend into a conventional mixing valve structure 44 having solenoids 45 and 46 and the mixing valve 44 is connected to a conduit means or hose 47. In a conventional manner selective alternative or concurrent energization of solenoids 45 and 46 opens and closes the water inlets into the mixing valve to provide the passage of hot, cold, warm water from the mixing valve 44 through the hose 47. Hose 47 is the water conduit means that allows the water to flow from the valve 44 to the tub 12 when one or both of solenoids 46 are energized to open the respective inlets. In water flow communication with hose 47 is a water sampling tank 48 which diverts a small portion of the water passing through the hose 47 through the tank, the purpose and detailed structure of which will now be described.

The details of the water sampling tank 48 is shown particularly in FIG. 2. The tank 48 is made from suitable plastic and two housing halves 50 and 52 are molded and joined at the parting line 54 by any suitable method, such as ultrasonic welding or by an adhesive. Part of the water sampling tank 48 also forms a portion of the conduit means 47 between the mixing water valve 44 and tub 12. That conduit portion 56 is U-shaped and has at one end an opening 57 for water to enter and at the opposite end an exit opening 59 for water to leave the U-shaped portion 56. Below the conduit portion 56 is a water chamber 58 formed by the two housing halves 50 and 52 and the conduit portion 56. The water chamber 58 has an inlet passageway 60 through the wall of the conduit portion 56 which allows a small amount of water passing through the conduit portion 56 to be diverted into the water chamber 58. At the end of the conduit portion 56 opposite the inlet passageway 60 there is an outlet passageway 62 that allows water from the water chamber 58 to pass back into the conduit portion 56. By this arrangement, when water is flowing through conduit 47 from the mixing water valve 44 to the tub 12, a small amount of the water is constantly being introduced into the water chamber 58, through the water chamber, and back into conduit 47 to provide a water flow-through system.

The wall of the water chamber 58 formed by the housing halves 50 and 52 contain at least one recess 64 which is shown in the form of a cylindrical or cup-shaped recess. This recess 64 is to receive and contain a temperature responsive switch such as thermostat 66*a* or 66*b*. In the drawings there is shown provision for two recesses 64 to receive two thermostats 66*a* and 66*b*, which for some clothes washer controls may be found desirable, as will be explained later. Ideally, the bottom wall 68 of the recess 64 is as thin as possible so that the thermostat will more readily sense the temperature of the water in the water chamber 58. The thermostat could, of course, be placed in direct contact with the water passing through the water chamber 58 as long as a liquid seal between the thermostats and the wall of the chamber could be effected to prevent leakage of water from the chamber 58.

As can be seen, particularly in FIGS. 1 and 3, the water sampling tank 48 is positioned in the upper portion of the washing machine 10 and just outside the tub 12. This cab be accomplished by securing bracket member 69 to which is attached the sampling tank 48 to a rigid support structure within the machine. Hose 47 leading from the mixing valve 44 is connected to inlet opening 57 of the conduit portion 56 of the water sampling tank 48 at the end 70. The exit opening 59 at the opposite end 72 of the conduit portion 56 of water sampling tank 48 has secured to it the continuation of hose 47. Hose 47 has a portion 74 which passes through the wall of the tub 12 with a water sealing gasket member 76 holding it in place and terminates in a nozzle 78 through which water is discharged into the clothes washer tub 12.

Figure 4:
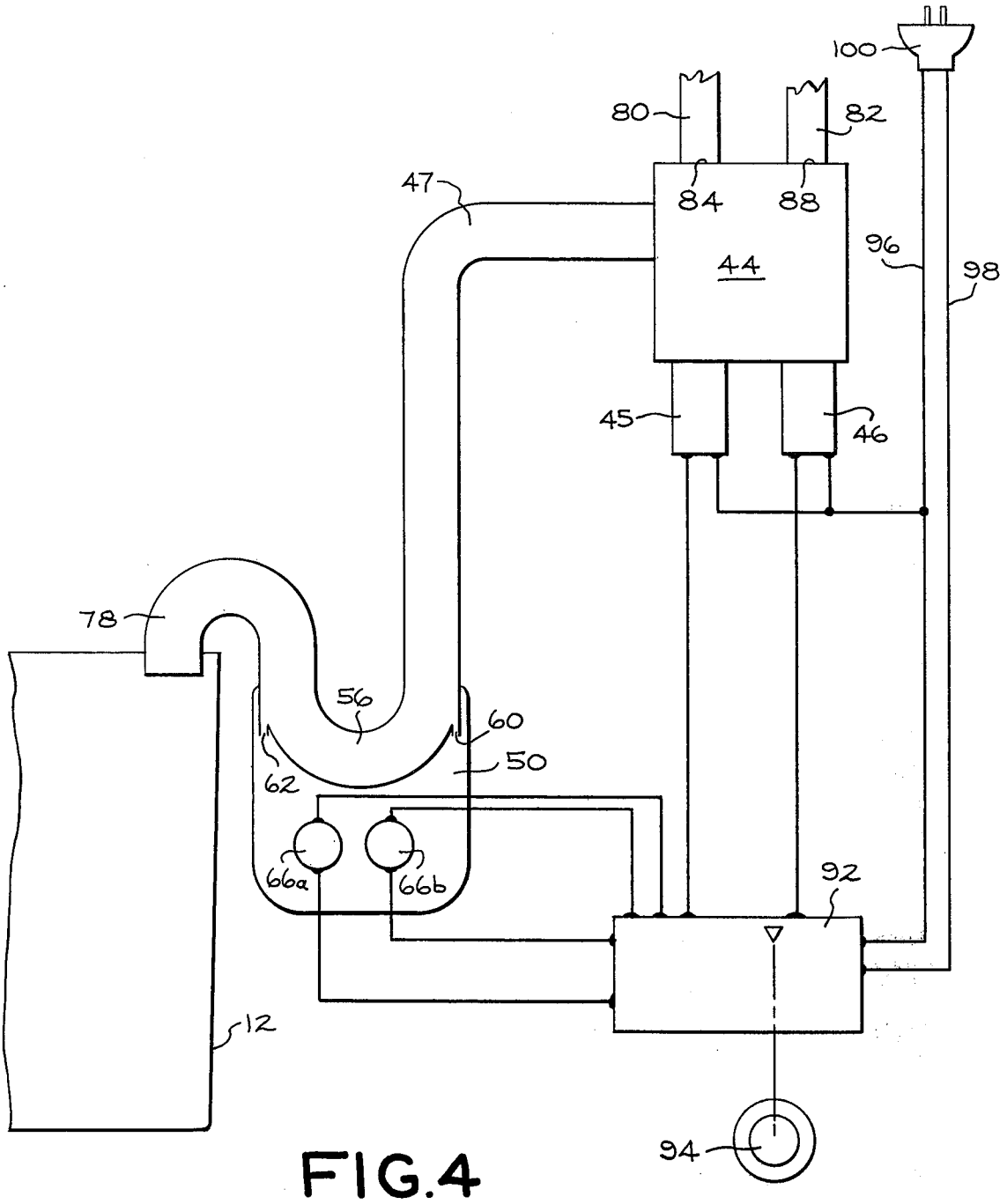
FIG. 4 is a schematic view of my invention.

With particular reference to FIG. 4 wherein the water sampling tank is shown and arranged in the control system, water coming into the clothes washer from an outside source, such as a household faucet, has both a hot water pipe 80 and a cold water pipe 82 which together introduce hot and cold water into the mixing water valve 44 through inlets 84 and 88, respectively.

Leading from the mixing valve 44 is the water conduit means or hose 47 which terminates at the nozzle 78 through which water is discharged into the tub 12. Controlling the hot water inlet 84 is a solenoid or other similar device 45 and the cold water inlet 88 is controlled by a similar solenoid 46. By controlling actuation of the respective solenoids the water inlets are correspondigly controlled, thus regulating whether hot or cold water or both is being introduced into the mixing valve 44. Located along and in water flow communication with the hose 47 is the water sampling tank 48 which is arranged as described heretofore to divert a small portion of the water passing through the hose 47 through the small inlet opening 60 into the water chamber 58, through the water chamber, and out the outlet 62 back into hose 47. The major portion of the water flows through U-shaped conduit portion 57. Hose 47 terminates at nozzle 78 where the water is discharged into tube 12. In the embodiment shown, two thermostat devices **66*a* and 66*b* are shown positioned in recesses 64 in the wall of the water chamber 58 and in temperature sensing relationship with the water passing through the chamber 58. A control box 92 represents the controls of the laundry machine which when actuated will operate the clothes washer automatically through the desired and present cycle operations. The solenoids 45 and 46 are connected electrically through the thermostats 66*a* and 66*b* to the control box 92. The control box is approxiately connected to AC house current by power leads 96 and 98 through a conventional power plug 100** for completion of the electrical circuit.

In operation then, the machine operator actuates the control box 92 by operating the control knob 94 and assuming that the machine is selectively programmed through the controls for a hot water fill, only solenoid 45 is energized to open hot water inlet 84 while cold water inlet 88 remains closed. Hot water is then being introduced into the clothes washer through water valve 44, conduit 47, nozzle 78 and into the tub 12. During introduction of the water into the tub a small sample portion of the water is passing through water sampling chamber 58 as described heretofore. By having thermostat **66*a* calibrated to actuate at some desired predetermined elevated temperature, say 125° F., should the temperature of the hot water being sensed rise above that value, the thermostat will trip and through control box 92 solenoid 46 will be actuated causing the cold water inlet 88 to open so that both hot and cold water are mixed by the water valve 44. Thermostat 66*a* is calibrated to reset at some desired predetermined temperature that is lower than the elevated temperature of 125° F. For instance if the reset temperature is 115° F., then when thermostat 66*a* senses the lower temperature of the water in the chamber 58, the thermostat opens and through the control box 92 solenoid 46 is de-energized thus closing the cold water inlet 88. As can be seen, this system and method allows the water introduced into the tub 12 to be regulated between 125° F. and 115° F. by simply controlling only the cold water inlet 88.** If the system cycles several times, say four or five times, the temperature of the mixed water will be very near the middle of the range of the temperature calibrated which in this case would be 120° F.

Should the clothes washer be selectively programmed through the controls for warm water to be introduced into the tub 12, then the washer controls allow both the hot water inlet 84 and the cold water inlet 88 to be open simultaneously during initial introduction of water itto the tub 12. As before, the temperature of the water passing through the water chamber 58 is sensed by the other thermostat **66*b*. Should that temperature exceed a desired predetermined value, say 85° F., then the solenoid 45 is actuated to close the hot water inlet 84. The thermostat 66*b* has a reset temperature lower than the first preselected temperature, such as 75° F., so that when that temperature is sensed in the sampling chamber 58, the thermostat 66*b* closes and through the control box 92 solenoid 45 is energized to open the hot water inlet 84. Thus, on the warm water setting the mixed water being introduced into the tub 12** will be maintained at a temperature between 85° F. And 75° F. If the system cycles several times the mixed water will be very near 80° F.

Most, if not all, clothes washer controls have a cold water selection setting that allows only cold water to be introduced into the tub 12. This is accomplished by the control system by-passing the thermostats **66*a* and 66*b* and only causing the solenoid 46 to be energized, thus opening the cold water inlet 88** until the machine is filled to the selected water level.

An alternative clothes washer water fill system that may be utilized with my invention is one wherein when either hot or cold water inlet is opened the other water inlet is closed simultaneously. While such a water fill system would increase the number of cycles for the valve solenoids as compared to the above-described fill systems, it has some desirable characteristics. For instance, in the previously described water temperature control systems if the thermostat was a snap-action thermostat the system could fail to accurately control the temperature of the water in the tub because the water temperature in the chamber being sensed by the thermostat does not fail outside the range of temperature diffierential of the particular thermostat. When the clothes washer controls are selectively programmed for warm water to be introduced into the tub 12 and the temperature sensed in the chamber 58 exceeds the desired predetermined upper temperature of 85° F., then the solenoid 45 is actuated to close the hot washer inlet 84. This of course leaves the cold water inlet 88 open. If, however, the cold water is not cold enough to reset the thermostat at the lower temperature of 75° F., cold water only will continue to fill the clothes washer, possibly resulting in the final water temperature in the tub being colder than desired. A similar condition could occur when the water temperature is just slightly below the upper predetermined temperature of 85° F. resulting in constant hot water flow and a higher final temperature of the mixed water in the tub than desired. By an arrangement wherein the one water inlet is turned off and the other is simultaneously turned on, the maximum temperature differential, that is, from pure hot to pure cold or vice versa, would flow into chamber 58 and be sensed by the thermostats **66*a* and 66*b*.** Moreover, such a system could use a thermostat with a much wider range of temperature differential between the trip and reset temperatures. In this arrangement, the temperature responsive switch could be a single pole, double throw type which will open either the hot water inlet or cold water inlet but not both at the same time.

It will be understood that a single thermostat may be used on some clothes washers where the controls only provide for two temperature selections such as hot and cold or warm and cold. In washers that have controls for three temperature selections such as hot, warm and cold, then two thermostats 66a and 66b may be utilized to control the system or only one thermostat may be used to control either the warm or hot selection, leaving the other uncontrolled.

It has been found that if the thermostat is placed directly in the hose 47 as with prior art arrangements, it will be subject to rapid and frequent cycling, thus causing the water valve solenoids to be actuated in like manner. This, of course, detrimentally affects the life of the components utilized in this function. If, however, the thermostat is placed in the small sampling tank as in this invention it has been found that is will cycle only about half the amount or less and yet the control of the water temperature passing into the tub is quite accurate to maintain the desired mixed water temperature. It has been found that in a system using from 6 gallons of water for the low level setting and 24 gallons for the high level, a thermostat that cycles from two to 10 times performs quite satisfactorily. Below two cycles the desired temperature of the water in the tub is not controlled accurately enough and above 10 cycles no additional temperature control advantage is achieved and the additional cycling could detrimentally affect the life of the thermostats and valve solenoids. Generally, less cycles of the system are needed for the low water level setting than the higher water level settings.

Preferably, of course, the temperature of the water in the sampling tank chamber 58 should closely simulate the mixed water temperature in the tub. One way this is achieved is by the water flow-through arrangement of the sampling tank which constantly mixes the water that is going into the tub so there is no stratification of the water as in the case of water in the tub 12. There is, therefore, a more nearly representative temperature of the water in the tub as if it was thoroughly mixed. Another way of helping closely simulate the mixed water temperature in the tub is to have the volume of the chamber 58, the rate of water flow into the chamber 58, and the rate of heat loss of the chamber proportional to those values for the tub 12.

It will be appreciated that by controlling the temperature of the water that a more energy efficient clothes washer is achieved as less energy is needed to heat the water above a temperature found to be satisfactory for the washing operation.

While the preferred embodiment of the invention described above is in connection with a vertical-axis, agitator-type clothes washer, it may be used in any other type clothes washer, including horizontal axis tumble type washers, that utilize an automatic water fill system.

It should be apparent to those skilled in the art that the embodiment described heretofore is considered to be the presently preferred form of this invention. In accordance with the patent statutes, changes may be made in the disclosed apparatus and the manner in which it is used without actually departing from the true spirit and scope of this invention.

What is claimed is:

1. In an automatic clothes washer having a tub for containing water and a water mixing valve with a hot water inlet and a cold water inlet, control means for opening and closing at least one of said water inlets to regulate the mixed water temperature in the tub including a temperature responsive switch, a water conduit means from the water valve to the tub, the improvement comprising:

a water sampling tank having an inlet opening, an outlet opening, and a water chamber therebetween, said tank being in water flow communication with the conduit means and arranged to divert a small portion of the water passing through the conduit means through the chamber, said temperature responsive switch being in temperature sensing relationship with the water in the chamber and calibrated to actuate at one preselected temperature and de-actuate at a preselected different temperature to regulate the mixed water temperature in the tub between the two temperatures.

2. The invention of claim 1 wherein the control means allows the hot water inlet to be normally open and the cold water inlet normally closed, and said temperature responsive switch is reponsive to a first preselected temperature to open the cold water inlet and responsive to a second preselected temperature to close the cold water inlet, said second temperature being lower than the first preselected temperature.

3. The invention of claim 1 wherein the control means allows the hot and cold water inlets to be normally open and said temperature responsive switch is responsive to a first preselected temperature to close the hot water inlet and responsive to a second preselected temperature to open the hot water inlet, said second temperature being lower than the first preselected temperature.

4. The invention of claim 1 wherein the control means allows one of the water inlets to open and simultaneously close the other water inlet.

5. The invention of claim 1 wherein the temperature responsive switch is a thermostat device and the wall of the tank has a recess for receiving the thermostat.

6. The invention of claim 1 wherein the water conduit means includes a U-shaped portion and the sampling tank is integrally molded therewithin and the tank inlet and outlet openings are through the U-shaped portion.

7. In an automatic clothes washer having a tub for containing water and a water mixing valve with a hot water inlet and a cold water inlet, control means for opening and closing said water inlets to regulate the mixed water temperature in the tub including a water temperature selection switch, two temperatures responsive switches, a water conduit means from the water valve to the tub, the improvement comprising;

a water sampling tank having an inlet opening, an outlet opening and a water chamber therebetween, said tank being in water flow communication with the conduit means and arranged to divert a small portion of the water passing through the conduit means through the chamber, said temperature responsive switches being in temperature sensing relationship with the water in the chamber, the control means providing for the hot water inlet to be normally open and the cold water inlet normally closed, and one of said temperature responsive switches is responsive to a first preselected temperature to open the cold water inlet and responsive to a second preselected temperature to close the cold water inlet, said second temperature being lower than the first preselected temperature, said control means also selectively allowing the hot and cold water inlets to be normally open and said second temperature responsive switch is responsive to a first preselected temperature to close the hot water inlet in response to a second preselected temperature to open the hot water inlet, said second temperature being lower than the first preselected temperature.

8. The improved method of controlling the temperature of mixed hot and cold water in an automatic clothes washer having a tub for containing water, a water mixing valve with a hot water inlet and a cold water inlet, control means including a temperature responsive switch calibrataed to actuate at one preselected temperature and de-actuate at a preselected different temperature for controlling at least one of the said water inlets, a water conduit means from the valve to the tub, comprising:

providing a water sampling tank having an inlet opening, an outlet opening, and a water chamber therebetween and in liquid flow communication with the conduit means, diverting a small portion of the water passing through the conduit means through the inlet opening into the tank, continuously removing water from the tank through the outlet opening into the conduit means, sensing the temperature of the water in the tank with the temperature responsive switch, and actuating and de-actuating the control means responsive to the predetermined temperatures to regulate the mixed water temperature in the tub between the two temperatures.

9. The improved method of controlling the temperature of mixed hot and cold water in an automatic clothes washer of claim 8 wherein the hot water inlet is maintained open and cold water inlet is opened and closed in response to the control means, said temperature responsive switch being responsive to a first preselected temperature to open the cold water inlet responsive to a second preselected temperature to close the cold water inlet, said second temperature being lower than the first preselected temperature.

10. The improved method of controlling the temperature of mixed hot and cold water in an automatic clothes washer of claim 8 wherein both the hot and cold water inlets are normally open and the temperature responsive switch is responsive to a first preselected temperature, to close the hot water inlet and responsive to a second preselected temperature to open the hot water inlet, said second temperature being lower than the first preselected temperature.

11. The improved method of controlling the temperature of mixed hot and cold water in an automatic clothes washer of claim 8 wherein the control means allows one of the water inlets to open and simultaneously close the other water inlet.

* * * * *

UNITED STATES PATENT AND TRADEMARK OFFICE

CERTIFICATE OF CORRECTION

PATENT NO. : 4,031,911

DATED : June 28, 1977

INVENTOR(S) : Joseph H. Frazar

It is certified that error appears in the above-identified patent and that said Letters Patent are hereby corrected as shown below:

Claim 6, line 3, "therewithin" should be - therewith -

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*